US007044097B2

(12) United States Patent
Wright

(10) Patent No.: US 7,044,097 B2
(45) Date of Patent: May 16, 2006

(54) CYLINDER HEAD

(75) Inventor: Kingsley Windham Bevan Charles Wright, Connah's Quay (GB)

(73) Assignee: Roton Engine Developments Ltd, Connahs' Quay (GB)

( * ) Notice: Subject to any disclaimer, the term of this patent is extended or adjusted under 35 U.S.C. 154(b) by 0 days.

(21) Appl. No.: 10/499,524

(22) PCT Filed: Jul. 10, 2003

(86) PCT No.: PCT/GB02/04672

§ 371 (c)(1),
(2), (4) Date: Jan. 10, 2005

(87) PCT Pub. No.: WO03/056143

PCT Pub. Date: Jul. 10, 2003

(65) Prior Publication Data

US 2005/0103303 A1 May 19, 2005

(30) Foreign Application Priority Data

Dec. 22, 2001 (GB) ..... 0130903.8

(51) Int. Cl.
*F01L 7/00* (2006.01)

(52) U.S. Cl. ..... 123/190.5; 123/188.17

(58) Field of Classification Search ..... 123/190.5, 123/190.1, 190.2, 188.17
See application file for complete search history.

(56) References Cited

U.S. PATENT DOCUMENTS

| | | | | |
|---|---|---|---|---|
| 5,249,553 | A | 10/1993 | Guiod | |
| 5,361,739 | A * | 11/1994 | Coates | 123/190.14 |
| 5,372,104 | A | 12/1994 | Griffin | |
| 5,655,494 | A | 8/1997 | Donaldson, Jr. | |
| 6,651,605 | B1 * | 11/2003 | Trentham | 123/190.8 |

FOREIGN PATENT DOCUMENTS

| | | |
|---|---|---|
| EP | 0 099 873 A2 | 2/1984 |
| NZ | 260141 | 6/1995 |

* cited by examiner

*Primary Examiner*—Mahmoud Gimie
*Assistant Examiner*—Katrina Harris
(74) *Attorney, Agent, or Firm*—Smith, Gambrell & Russell, LLP

(57) ABSTRACT

A cylinder head 12 showing a guideway in which is located a rotatable valve 10, 12 comprising a fluid port operable to effect fluid communication between a cylinder and a fulid manifold in the guideway, whereby rotation of the valve effects alignment of the fluid port with the combustion chamber of a cylinder 4 to enable fluid flow between the valve 10, 12 and a cylinder 4, and wherein the cylinder head 2 further comprises a seal 22 which, in use, is movable from a first, non-sealing position in which the seal 22 is biased away from the valve 10, 12, and a second, sealing position in which the seal 22 is biased onto the valve by gaseous pressure from within a cylinder 4.

22 Claims, 6 Drawing Sheets

CYLINDER HEAD

FIELD OF THE INVENTION

The present invention relates to cylinder heads for combustion engines, and in particular, but not exclusively to cylinder heads for four-stroke internal combustion engines.

BACKGROUND TO THE INVENTION

In a conventional four-stroke internal combustion engine, a power piston is disposed for reciprocating movement within a cylinder. The top of the cylinder is closed by a cylinder head that carries one or more induction poppet valves and one or more exhaust poppet valves. The induction poppet valve is timed so as to open as the power piston moves down the cylinder and, with the resultant partial vacuum, draws a combustible gas past the open poppet valve and into the cylinder. In respect of pressurised induction systems, the partial vacuum becomes positive pressure being forced into the negative pressure part of the cylinder as the piston moves down the cylinder. The induction poppet valve is then timed so as to close at the point when the piston is near the lowest point of its travel, thereby trapping a cylinder full of combustible gas. As the power piston is pushed back up the cylinder, by virtue of being connected to a crank that continues to rotate, it compresses the gas. At a point near the top of this cycle, called the compression stroke, a spark plug, which has been designed into the cylinder head, is sparked, causing the gas to ignite and rapidly expand as it explodes, pushing the piston down. As the piston comes back up again, the exhaust poppet valve (or valves) is (or are) timed to open, allowing the gases to escape.

Poppet valves have been used in internal combustion engines for many years, but display some disadvantages. Poppet valves are relatively expensive to manufacture and incorporate into cylinder heads of combustion chambers, due to the fine machining required to effect tolerances required for use of the valves in the hostile environment within the cylinder head.

Poppet valves, although fairly robust in construction, and although they initially create fluid-tight seals, restrict the flow of fuel and gases into and out of the engine, as the fuel and gas must flow around the valve and its associated stem. Poppet valves are also a source of vibration and noise through the effects of metal to metal contact with the cylinder head of the engine. Furthermore, as revolutions of the engine increase, the ability of poppet valves to open and close in time decreases in efficiency to the point where power output cannot increase further. Poppet valves are also a large source of friction, as is the camshaft and spring loaded follower generally used to open and close the valve.

There are known engines which do not comprise poppet valves, such as rotary engines and two-stroke piston engines, but such engines are generally inefficient in fuel consumption and costly to maintain.

It is therefore an aim of preferred embodiments of the present invention to overcome or mitigate a problem of the prior art, whether expressly mentioned hereinabove or not.

SUMMARY OF THE INVENTION

According to the present invention there is provided a cylinder head for mounting on a cylinder of a combustion engine, the cylinder head comprising a guideway in which is located a rotatable valve comprising a fluid port operable to effect fluid communication between a cylinder and a fluid manifold in the guideway, whereby rotation of the valve effects alignment of the fluid port with the combustion chamber of a cylinder to enable fluid flow between the valve and a cylinder, and wherein the cylinder head further comprises a seal which, in use, is movable from a first, non-sealing position in which the seal is biased away from the valve, and a second, sealing position in which the seal is biased onto the valve by gaseous pressure from within a cylinder.

Preferably there is a single rotatable valve which comprises two fluid ports comprising a fluid inlet and a fluid outlet, cooperable with corresponding inlet and outlet manifolds in the guideway.

The fluid inlet may be diametrically opposite to the fluid outlet on the rotatable valve. Preferably however the fluid inlet is axially spaced apart from the fluid outlet along the rotatable valve.

Alternatively the cylinder head may comprise a first rotatable valve located in a first guideway, and a second rotatable valve, located in a second guideway, the first valve comprising a fluid inlet and the second valve comprising a fluid outlet.

Preferably the rotatable valve comprises a rotatable shaft or bar, and more preferably comprises a rotatable shaft or bar having a substantially circular cross-section.

Suitably the fluid port of the rotatable valve comprises a cut-out portion of the valve.

Preferably the fluid port of the rotatable valve comprises an aperture or slot extending diametrically through the valve such that rotation of the valve effects movement between an open position in which the aperture or slot is substantially aligned with a cylinder and the fluid manifold in the guideway, and a closed position in which the slot or aperture is substantially aligned with the surface of the guideway.

Preferably the seal is in fluid communication with a cylinder.

Suitably the seal comprises a resilient biasing means, the resilient biasing means being arranged to bias the seal to the first non-sealing position, until such a time in the combustion cycle of the combustion engine when the build-up of exhaust gases effects sufficient pressure to effect movement of the seal against the resilient biasing means to the second, sealing position.

Suitably the resilient biasing means is a spring, preferably a helical spring.

Preferably the seal is located in a port or duct in the cylinder head which at one end opens into a cylinder and at the other end opens into the guideway of the cylinder head. Preferably the seal, in the first position, is located substantially within the port or duct, and in the second position extends from the port or duct into the guideway to effect abutment with the rotary valve.

Suitably, in the second position the seal is arranged to extend partway into the rotary valve fluid port when said fluid port is in substantial alignment with the seal.

The cylinder head may be dimensioned to be mounted on a plurality of cylinders and the rotary valve may comprise a fluid port for each cylinder, wherein rotation of the valve effects temporally separate alignment of each fluid port with the combustion chamber of a prescribed cylinder. Suitably the guideway comprises a fluid manifold for each fluid port of the rotary valve. The rotary valve may comprise two fluid ports for each cylinder, comprising a fluid inlet and fluid outlet, cooperable with corresponding fluid manifolds in the guideway. Preferably the cylinder head further comprises at least one cylinder isolation seal, which extends substantially around the rotary valve between the valve and the interior of the guideway, each isolation seal arranged to prevent fluid from flowing through the guideway between adjacent cylinders.

Suitably the rotary valve is arranged to be operably connected to a crankshaft of a combustion engine when the cylinder head is mounted on a cylinder, such that the rotary valve is rotated relative to the crankshaft at one quarter of the speed of the crankshaft.

According to a second aspect of the present invention there is provided a cylinder head for mounting on a cylinder of a combustion engine, the cylinder head comprising a single guideway in which is located a rotary valve comprising a fluid inlet and a fluid outlet, operable to effect fluid communication between a cylinder and a corresponding inlet manifold and outlet manifold in the guideway, wherein rotation of the valve effects alignment of the fluid inlet and fluid outlet with a combustion chamber of a cylinder to enable, in use, fluid flow between the valve and a cylinder, and wherein the fluid inlet and fluid outlet are axially spaced along the rotary valve.

Preferably the rotatable valve comprises a rotatable shaft or bar, and more preferably comprises a rotatable shaft or bar having a substantially circular cross-section.

Suitably the fluid inlet and fluid outlet comprise cut-out portions of the valve.

Preferably the fluid inlet and fluid outlet comprise an aperture or slot extending diametrically through the valve such that rotation of the valve effects movement between an open position in which the aperture or slot of the inlet or outlet is substantially aligned with a cylinder and the corresponding inlet manifold or outlet manifold in the guideway, and a closed position in which the aperture or slot is substantially aligned with the surface of the guideway.

Suitably movement of the fluid inlet between the open and closed position is effected at a different time to movement of the fluid outlet between the open and closed position, and this may be effected by providing a fluid inlet and outlet which each comprise an aperture or slot extending diametrically through the valve at an angle to one another.

Suitably the rotary valve is arranged to be operably connected to a crankshaft of a combustion engine when the cylinder head is mounted on a cylinder, such that the rotary valve is rotated relative to the crankshaft at one quarter of the speed of the crankshaft.

The cylinder head may further comprise one or more seals as described hereinabove for the first aspect of the invention. The cylinder head may be dimensioned to be mounted on a plurality of cylinders and the rotary valve may comprise a fluid inlet and fluid outlet for each cylinder, wherein rotation of the valve effects temporally separate alignment of each fluid inlet and fluid outlet with the combustion cylinder of a prescribed cylinder.

According to a third aspect of the invention there is provided a combustion engine comprising a cylinder head of the first or second aspects of the invention, mounted to a cylinder. Preferably the combustion engine is an internal combustion engine and is more preferably a four-stroke engine.

BRIEF DESCRIPTION OF THE DRAWINGS

For a better understanding of the various aspects of the invention, and to show how embodiments of the same may be put into effect, preferred embodiments of the invention will now be described with reference to the accompanying drawings, in which.

DESCRIPTION OF THE PREFERRED EMBODIMENTS

Figure 1A:
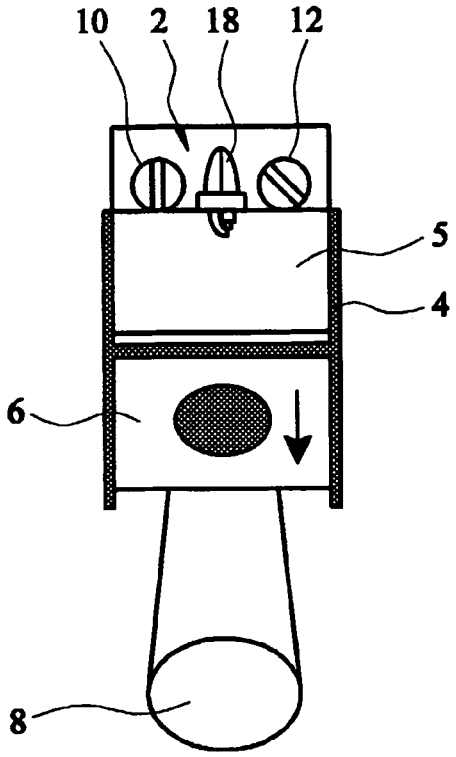
FIGS. 1A–1D illustrate front sectional views of a preferred embodiment of a cylinder head of the invention, mounted to a cylinder of a four-stroke internal combustion engine, moving through the exhaust, induction, compression and power strokes.

Referring firstly to FIGS. 1A–1D, and FIGS. 2A and 2B, a first preferred embodiment of a cylinder head 2 of the invention, is mounted on a cylinder 4 of a four-stroke internal combustion engine. The cylinder 4 comprises a combustion chamber 5 within which is mounted a piston 6, rotatably connected to the crankshaft 8 of the engine.

The cylinder head comprises two rotary valves 10 and 12. The rotary valve 10 comprises a port in the form of an inlet 14 which is a cut-out portion of the rotary valve extending diametrically therethrough.

The rotary valve 12 comprises a port in the form of an outlet 16 which is a cut-out portion of the rotary valve 12 extending diametrically therethrough.

The rotary valves 10 and 12 are linked to the crankshaft 8 by means well known to persons skilled in the art, such that they are arranged to rotate at one quarter the speed of the crankshaft 8.

The cylinder head 2 also includes a spark plug 18 which is in communication with the combustion chamber 5 of the cylinder 4.

Figure 2A:
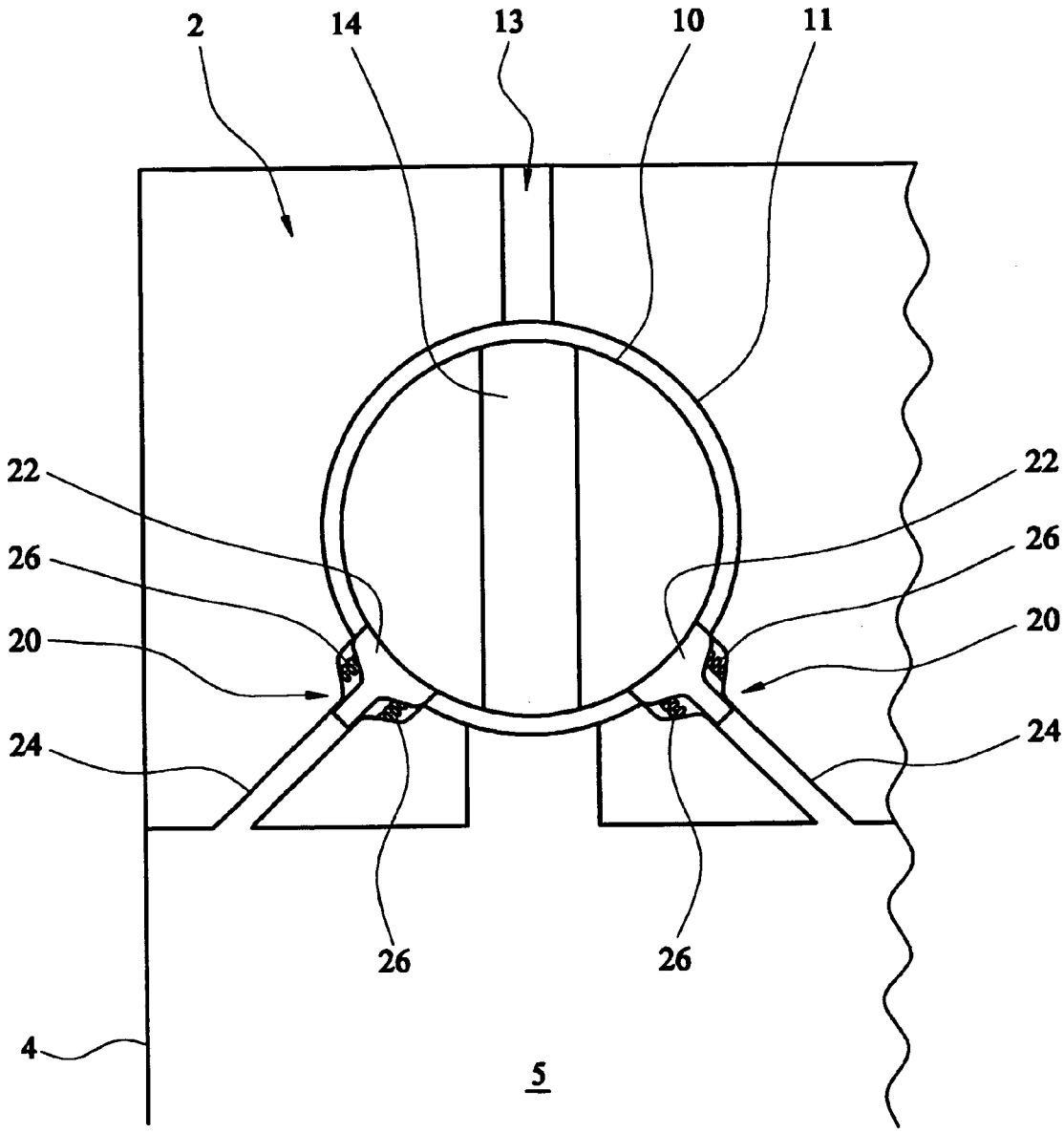
FIG. 2A illustrates a front sectional view of part of the preferred embodiment of a cylinder head mounted on a cylinder of FIGS. 1A–1D, during the induction stroke of the combustion cycle according to the invention.
Figure 2B:
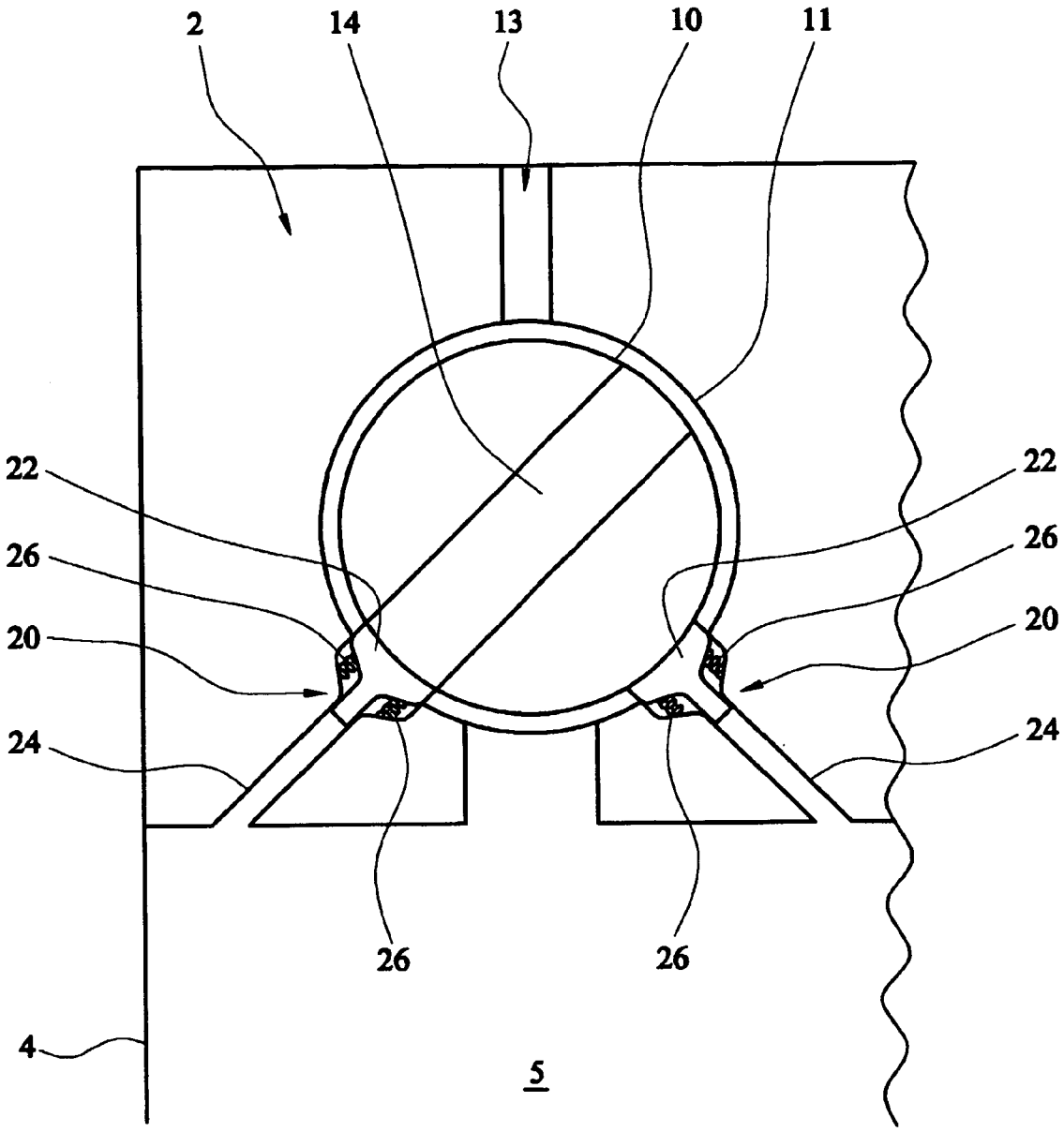
FIG. 2B illustrates the front sectional view of FIG. 1A, during the exhaust stroke of the combustion cycle.

We turn to FIGS. 2A and 2B, which show a close-up sectional view of the cylinder head 2 showing the rotary valve 10 and inlet 14. The rotary valve 10 is mounted in a guideway 11, which guideway is in fluid communication with a manifold inlet port 13 in the cylinder head 2. The cylinder head 2 also includes two seals 20 which are radially mounted in ducts 24 in fluid communication with the rotary valve 10 and the combustion chamber 5. The seals 20 comprise a sealing member in the form of a resilient plug 22 which is connected within the ducts 24 by two resilient biasing means in the form of helical springs 26. The plugs 22 are in communication with the guideway 11 and the ducts 24.

The rotary valve 12 is mounted in a similar guideway (not shown) which includes a manifold outlet, and the cylinder head 2 comprises two further seals 20 which are mounted in ducts in fluid communication between the rotary valve 12 and the combustion chamber 5.

In use the engine is started as is known to persons skilled in the art. The engine runs through a four-stroke cycle as shown in FIGS. 1A–1D, comprising an exhaust stroke (FIG. 1A), induction stroke (FIG. 1B), compression stroke (FIG. 1C) and power stroke (FIG. 1D), which cycle is well known. During the power stroke, the spark plug 18 is activated to create a spark which ignites fuel injected or carburated into the combustion chamber 5 of the cylinder 2 during the induction stroke.

As the cycle reaches the induction stroke as shown in FIG. 1A, the rotary valve 10 comprising the inlet 14 is rotated by way of rotation of the crankshaft 8 such that the inlet 14 becomes aligned in fluid communication between the inlet manifold 13 and the combustion chamber 5, as illustrated in FIG. 2A. In this position fuel, or fuel and air, is injected through the inlet manifold 13, through the inlet 14 and into the combustion chamber 5.

Figure 1B:
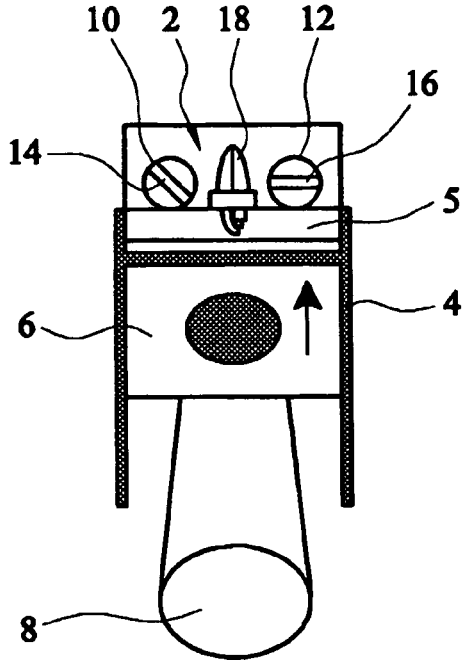

During the induction stroke the outlet 16 is not in fluid communication with the combustion chamber 5. After the fuel, or fuel and air, has been injected, the crankshaft 8 continues to rotate, which in turn rotates the valves 10 and 12. As the crankshaft 8 rotates, the cylinder moves to the compression stroke as shown in FIG. 1B, in which the piston 6 of the cylinder is moved up towards the cylinder head 2, compressing the fuel (and air). During the compression stroke, neither of the rotary valves 10 or 12 are in fluid communication with either the combustion chamber 5 or their associated guideway manifolds.

Figure 1C:
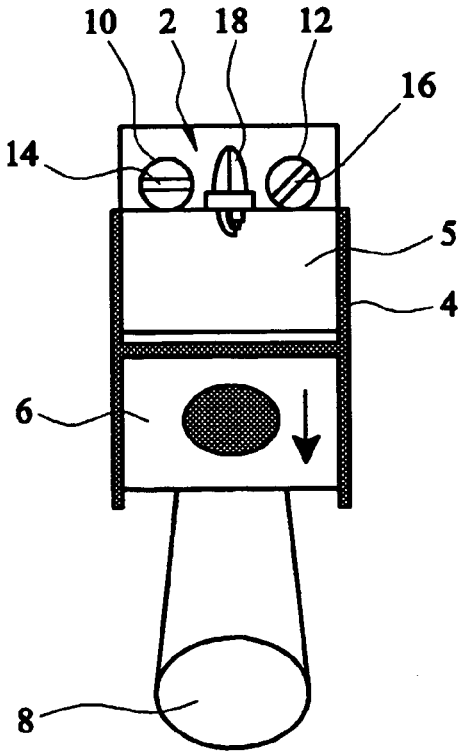

At the end of the compression stroke the spark plug 18 is activated to create a spark in the combustion chamber and ignite the fuel or fuel/air mixture. The resultant combustion within the combustion chamber 5 drives the piston downwardly, rotating the crankshaft 6 and thus the valves 10 and 12. During this power stroke, as illustrated in FIG. 1C, the rotation of the valves 10 and 12 does not result in them moving into fluid communication with the combustion chamber 5 or their associated guideway manifolds.

Figure 1D:
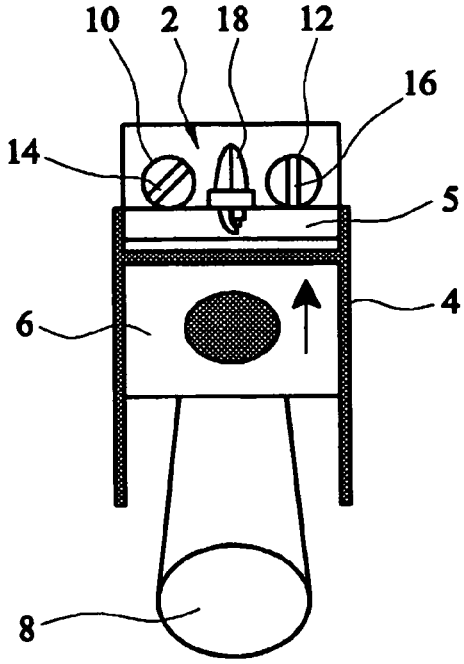

When the piston has reached its most downward point, further rotation of the crankshaft 8 pushes the piston towards the cylinder head 2 in the exhaust stroke, as illustrated in FIG. 1D. As the cylinder enters the exhaust stroke, the valve 10 comprising the inlet 14 is rotated via the crankshaft 5 such that it remains in non-fluid communication between the combustion chamber 5 and its associated manifold inlet 13 of the guideway 11. The rotary valve 12 is rotated during the exhaust stroke such that the outlet 16 moves into fluid communication between the combustion chamber 5 and the associated manifold outlet (not shown) of its guideway (not shown). Thus as the piston 6 is pushed upwardly, the exhaust gas generated by combustion in the induction stroke is forced through the outlet 16 in valve 12, through the manifold outlet of the guideway and out of the cylinder head 2, to the engine's exhaust (not shown).

We turn now to FIGS. 2A and 2B. During the four-stroke cycle of the engine, a large quantity of gas is generated, especially in the form of exhaust gases. In order to prevent flow of exhaust gases, or any other fluid present, between the valves 10 and 12 and their associated guideways, seals 20 are utilised.

In use, when sufficient gas has built up within the combustion chamber 5, usually during the exhaust stroke, the seals 20 are activated to prevent fluid flow between the valves 10 and 12 and the guideways.

As gas builds up within the combustion chamber 5, gaseous pressure builds up in the ducts 24 until the pressure is sufficient to overcome the bias of springs 26 and push the sealing members 22 on to the valves 10 and 12, thereby forming a seal across their associated guideways in which the valves 10 and 12 are located.

As shown in FIG. 2B, during the exhaust stroke, the valve 10 is oriented such that one end of the inlet 14 is adjacent to, and facing one of the sealing members 22. Thus as the sealing member 22 is pushed onto the valve 10, it is pushed into the open end of the inlet 14, thereby creating a fluid tight seal. The use of rubber or similar material in the sealing member 22 helps to create a fluid-tight seal due to compression of the member 22 as it enters the inlet 14.

As the four-strike cycle continues and the gaseous pressure drops within the combustion chamber 5, the drop in pressure in the ducts 24 allows the springs 26 to bias against the lowered pressure and pull the sealing member 22 away from the valves 10 and 12 and allow unrestricted rotation of the valves, as illustrated in FIG. 2A.

Turning now to FIGS. 3A–3D and 4, a second preferred embodiment of a cylinder head of the present invention is similar to that of FIGS. 1A–1D, 2A and 2B. Like reference numerals describe like features.

In this embodiment the cylinder head 2 comprises only one rotary valve 28 which comprises two ports in the form of an inlet 30 and outlet 32. The inlet 30 and outlet 32 are axially spaced apart, one behind the other, along the rotary valve 28 and each comprises a cut-out portion of the valve 28 extending diametrically therethrough.

Figure 4:
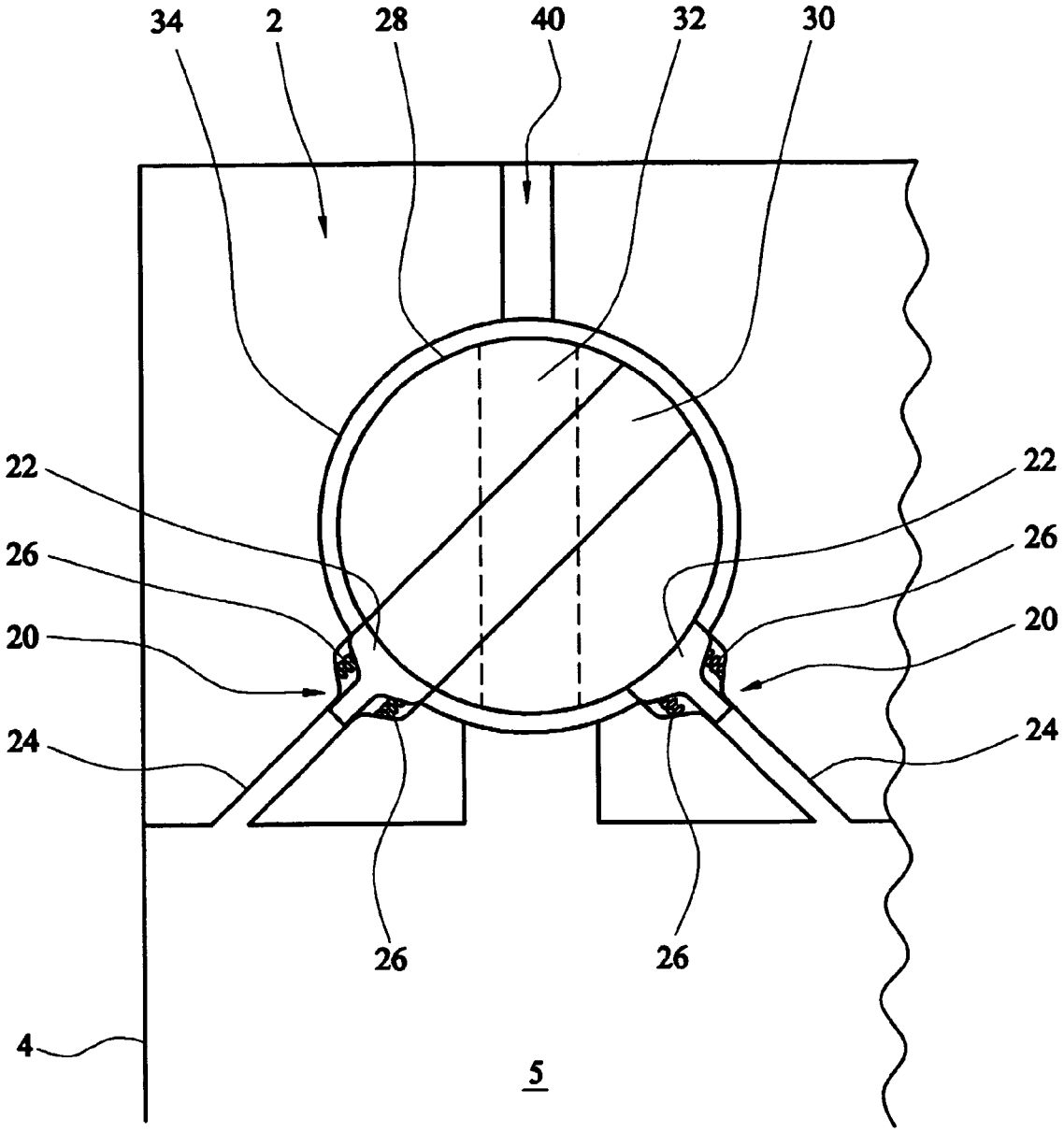
FIG. 4 illustrates a front sectional view of part of the cylinder head of FIGS. 3A–3D, during the exhaust stroke of the combustion cycle.

The valve 28 is located in a guideway 34 in the cylinder head 2, as shown in FIG. 4. The guideway includes an outlet manifold 13 and an inlet manifold (not shown) which are spaced apart along the guideway 34. Thus the manifolds are arranged in guideway 34 at locations parallel with the outlet 32 and inlet 30 of the valve 28 located within the guideway 34.

The inlet 30 and outlet 32 of the valve 28 extend diametrically through the valve 28 at a different angle to each other such that when the valve 28 is rotated, the inlet 30 and outlet 32 are in fluid communication between the combustion chamber 5 and their respective manifold inlet and outlet at different times in the combustion cycle.

The cylinder head further comprises four seals 20. Two seals are provided in the cylinder head adjacent to the guideway 34 axially parallel with the location of the inlet 30 of the valve 28 located in the guideway as shown in FIG. 4. A further two seals are provided in the cylinder head 2 parallel with the location of the outlet 32 (not shown). The seals 20 are substantially as described for the embodiment of FIGS. 1A–1D and 2A–2B.

In use the combustion cycle is repeated as for the embodiment of FIGS. 1A–1D, 2A and 2B but in this embodiment the single valve rotates at a quarter of the speed of the crankshaft and the diametric angles of the inlet 30 and outlet 32 is such that during the exhaust stroke, the outlet 30 is aligned to provide fluid communication between the combustion chamber 5 and the outlet manifold 40 for passage of exhaust gases from the combustion chamber 5. At the same time, during the exhaust stroke, the inlet 30 is not in fluid communication between the combustion chamber 5 and the inlet manifold (not shown) due to the different diametric angle of the inlet 30 through the valve 28, as shown in FIG. 4.

When the engine enters the induction stroke the valve 28 is rotated such that the outlet 32 moves out of fluid communication between the combustion chamber 5 and the outlet manifold 40 of the guideway 34. At the same time the inlet 30 is rotated to effect fluid communication between the combustion chamber 5 and the inlet manifold of the guideway 34, such that fuel or fuel and air, is injected into the combustion chamber.

Figure 3A:
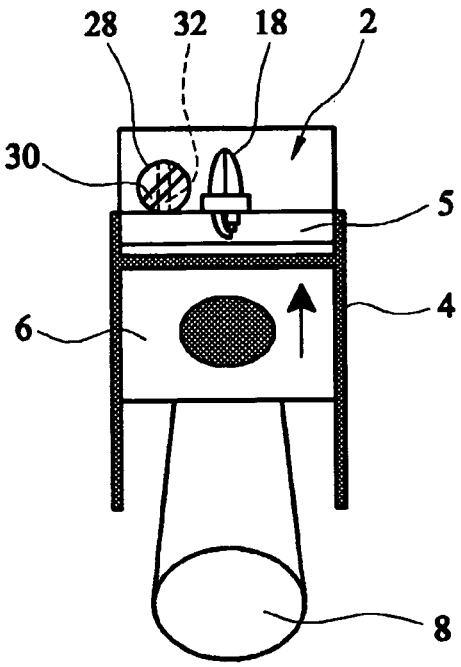
FIGS. 3A–3D illustrate front sectional views of a second preferred embodiment of a cylinder head of the invention, mounted to a cylinder of any four-stroke internal combustion engine, moving through the exhaust, induction, compression and power strokes of the combustion cycle.
Figure 3B:
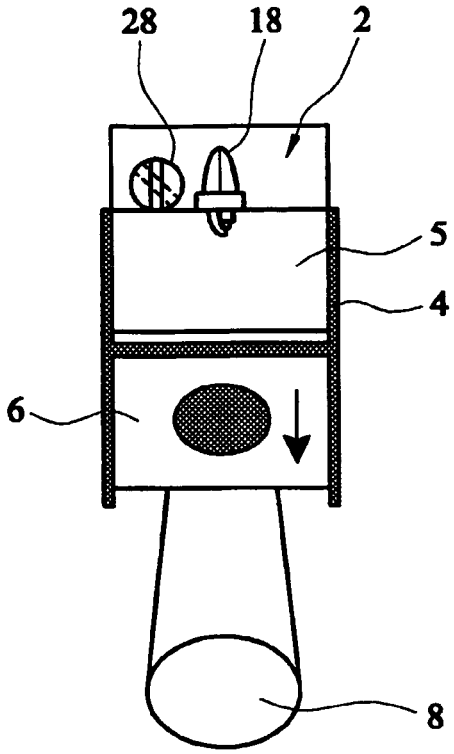
Figure 3C:
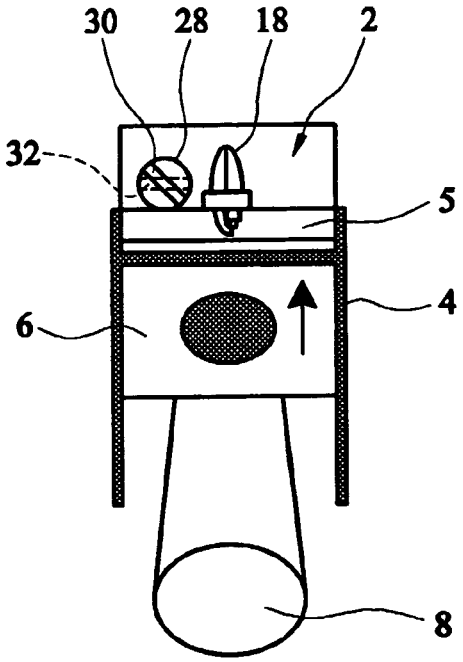
Figure 3D:
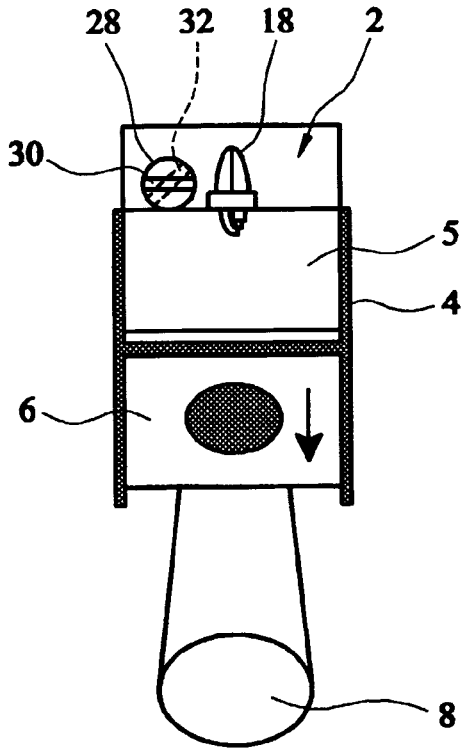

During the compression and power strokes of the combustion cycle, the valve 18 is rotated such that neither the inlet 30 and outlet 32 are in fluid communication with the combustion chamber 5, as shown in FIGS. 3C and 3D.

The seals 20 work in substantially the same way as do the seals of the embodiment of FIGS. 1A–1D and 2A–2B.

Figure 5:
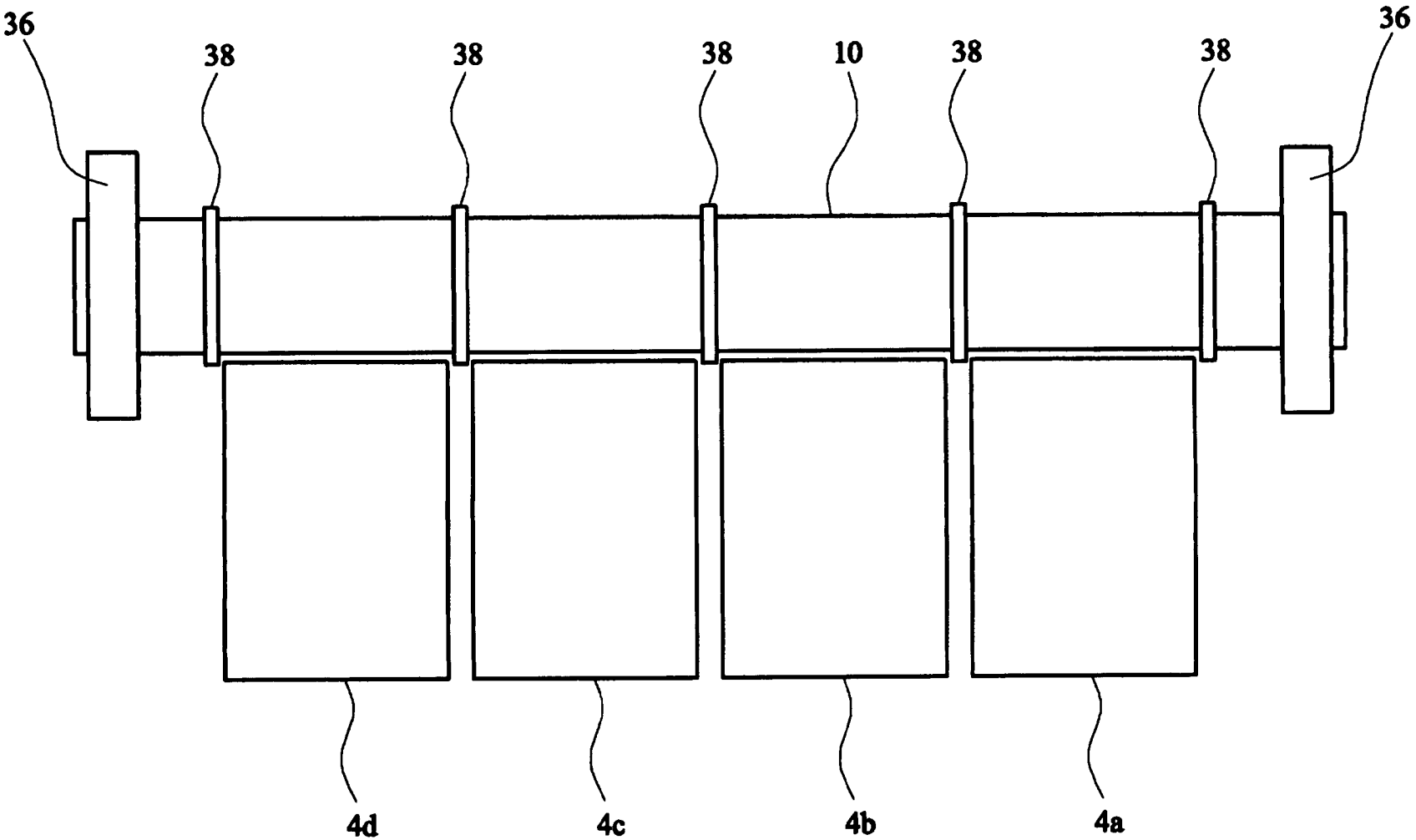
FIG. 5 illustrates a side sectional view of a rotary valve useful in a cylinder head (not shown) of the present invention, which is mounted on four cylinders in a four cylinder combustion engine.

We turn now to FIG. 5, which shows a side-sectional view of a rotary valve of a cylinder head of the invention mounted on four cylinders in a four cylinder combustion engine. The cylinder head is not shown in this embodiment.

The rotary valve 10 which is located in a guideway (not shown) in the cylinder head, is connected to the cylinder head by bearings 36 located at either end of the valve 10. The valve 10 is a cylindrical member having four pairs of inlet and outlets (not shown), each pair being spaced apart axially along the valve 10 and each inlet and outlet of a pair being spaced apart axially of each other.

The cylinder head is mounted on top of a four cylinder engine block such that each of the pairs of inlets and outlets of the valve 10 is located aligned over a cylinder 4A–4D.

The valve 10 is connected to the crankshaft of the engine and arranged to rotate at one quarter of the speed of the eligine. The inlets and outlets of the valve 10 are as described for the embodiment of FIGS. 3A–3D and 4 and operate in the same manner. Thus rotation of the valve 10 will move the inlets and outlets through the induction, compression, power and exhaust strokes as described hereinbefore.

Each pair of inlets and outlets are oriented off-set to each of the other pairs, such that each of the four cylinders will separately be in one of the four-strokes of the combustion cycle at any one time.

The rotary valve 10 also comprises split seal gaskets 38 extending substantially around the valve 10 within the guideway, located at either end of the guideway and between each of the cylinders 4A to 4D. The split seal gaskets 38 are dimensioned to contact both the valve 10 and guideway and create a seal therebetween. Thus any gas or fluid which may escape into the guideway of the cylinder head will be retained in a prescribed section of the guideway between two of the gaskets 38 and thus prevented from escaping into another cylinder of inlet or outlet of the valve 10.

The split seal gaskets 38 may be used on the valve 28 of the embodiment of the cylinder head 2 described for FIGS. 3A–3D and 4, or for each of the valves 10 and 12 of the cylinder head 2 of FIGS. 1A–1D and 2A–2B.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiments(s). The invention extend to any novel one, or any novel combination, of the features disclosed in this specification (including any accompanying claims, abstract and drawings), or to any novel one, or any novel combination, of the steps of any method or process so disclosed.

The invention claimed is:

1. A cylinder head for mounting on a cylinder of a combustion engine, the cylinder head comprising a guideway in which is located a rotatable valve comprising a fluid port operable to effect fluid communication between a cylinder and a fluid manifold in the guideway, whereby rotation of the valve effects alignment of the fluid port with the combustion chamber of a cylinder to enable fluid flow between the valve and a cylinder, and wherein the cylinder head further comprises a seal which, in use, is movable from a first, non-sealing position in which the seal is biased away from the valve, and a second, sealing position in which the seal is biased onto the valve by gaseous pressure from within a cylinder, and wherein the seal is located in a port or duct in the cylinder head which at one end opens into a cylinder when the cylinder head is mounted on a cylinder, in use, and at the other end opens into the guideway of the cylinder head.

2. The cylinder head of claim 1 wherein a single rotatable valve has two fluid ports comprising a fluid inlet and a fluid outlet, co-operable with corresponding inlet and outlet manifolds in the guideway.

3. The cylinder head of claim 2 wherein the fluid inlet is axially spaced apart from the fluid outlet along the rotatable valve.

4. The cylinder head of claim 1 comprising a first rotatable valve located in a first guideway, and a second rotatable valve, located in a second guideway, the first valve comprising a fluid inlet and the second valve comprising a fluid outlet.

5. The cylinder head of claim 1 wherein the rotatable valve comprises a rotatable shaft or bar.

6. The cylinder head of claim 1 wherein the fluid port of the rotatable valve comprises a cut-out portion of the valve.

7. The cylinder head of claim 1 wherein the fluid port of the rotatable valve comprises an aperture or slot extending diametrically through the valve such that rotation of the valve effects movement between an open position in which the aperture or slot is substantially aligned with a cylinder and the fluid manifold in the guideway, and a closed position in which the slot or aperture is substantially aligned with the surface of the guideway.

8. The cylinder head of claim 1 wherein the seal is in fluid communication with a cylinder.

9. The cylinder head of claim 1 wherein the seal comprises a resilient biasing means, the resilient biasing means being arranged to bias the seal to the first non-sealing position, until such a time in the combustion cycle of the combustion engine when the build-up of exhaust gases effects sufficient pressure to effect movement of the seal against the resilient biasing means to the second, sealing position.

10. The cylinder head of claim 9 wherein the resilient biasing means is a spring.

11. The cylinder head of claim 1 wherein in the first position the seal is located substantially within the port or duct, and in the second position extends from the port or duct into the guideway to effect abutment with the rotary valve.

12. The cylinder head of claim 1 wherein in the second position the seal is arranged to extend partway into the rotary valve fluid port when said fluid port is in substantial alignment with the seal.

13. The cylinder head of claim 1 wherein in the second position the seal is arranged to extend partway into the rotary valve fluid port when said fluid port is in substantial alignment with the seal.

14. The cylinder head of claim 1 dimensioned to be mounted on a plurality of cylinders and the rotary valve comprises a fluid port for each cylinder, wherein rotation of the valve effects temporally separate alignment of each fluid port with the combustion chamber of a prescribed cylinder.

15. The cylinder head of claim 14 wherein the guideway comprises a fluid manifold for each fluid port of the rotary valve.

16. The cylinder head of claim 14 wherein the rotary valve comprises two fluid ports for each cylinder, comprising a fluid inlet and fluid outlet, co-operative with corresponding fluid manifolds in the guideway.

17. The cylinder head of claim 15 wherein the rotary valve comprises two fluid ports for each cylinder, comprising a fluid inlet and fluid outlet, co-operable with corresponding fluid manifolds in the guideway.

18. The cylinder head of claim 14 wherein the cylinder head further comprises at least one cylinder isolation seal, which extends substantially around the rotary valve between the valve and the interior of the guideway, each isolation seal arranged to prevent fluid from flowing through the guideway between adjacent cylinders.

19. The cylinder head of claim 15 wherein, the cylinder head further comprises at least one cylinder isolation seal, which extends substantially around the rotary valve between the valve and the interior of the guideway, each isolation seal arranged to prevent fluid from flowing through the guideway between adjacent cylinders.

20. The cylinder head of claim 16 wherein the cylinder head further comprises at least one cylinder isolation seal, which extends substantially around the rotary valve between the valve and the interior of the guideway, each isolation seal arranged to prevent fluid from flowing through the guideway between adjacent cylinders.

21. The cylinder head of claim 1 wherein the rotary valve is arranged to operably connected to a crankshaft of a combustion engine when the cylinder head is mounted on a cylinder, such that the rotary valve is rotated relative to the crankshaft.

22. A combustion engine comprising a cylinder head of claim 1 mounted to a cylinder.

* * * * *